United States Patent [19]

Takebe et al.

[11] Patent Number: 5,047,759

[45] Date of Patent: Sep. 10, 1991

[54] IMAGE DISPLAY SYSTEM

[75] Inventors: Hideharu Takebe, Hyogo; Tomoaki Makino, Kanagawa, both of Japan

[73] Assignee: Mitsubishi Denki Kabushiki Kaisha, Tokyo, Japan

[21] Appl. No.: 336,940

[22] Filed: Apr. 11, 1989

[30] Foreign Application Priority Data

Apr. 22, 1988 [JP] Japan ..... 63-101114

[51] Int. Cl.[5] ..... G09G 1/02

[52] U.S. Cl. ..... 340/789; 340/731; 340/798

[58] Field of Search ..... 340/731, 789, 798, 799

[56] References Cited

U.S. PATENT DOCUMENTS 4,479,119 10/1984 Sakano ..... 340/731
4,616,219 10/1986 Tanaka et al. ..... 340/731
4,772,883 9/1988 Kitano ..... 340/731
4,916,747 4/1990 Arimoto ..... 340/731

*Primary Examiner*—Jeffery A. Brier
*Attorney, Agent, or Firm*—Townsend and Townsend

[57] ABSTRACT

An image display system is disclosed, which comprises a sync signal generator for receiving a clock selected by a clock selection circuit and generating sync signals conforming to a display screen, a timing signal generator for generating various timing signals, a refresh memory for storing pixel data for display on said display screen, a display data processor for converting pixel data read out from the refresh memory into said timing signals, and a display medium having a fixed display resolution for receiving the outputs of said display data processor and sync signal generator for display of data. The image display system further comprises a clock selection controller for either allowing or inhibiting the clock selection by the clock selection circuit.

4 Claims, 3 Drawing Sheets

IMAGE DISPLAY SYSTEM

BACKGROUND OF THE INVENTION

1. Field of the Invention

This invention relates to an image display system and, more particularly, to an image display system using a display medium having a fixed display screen resolution, e.g., a liquid crystal display panel or a plasma display panel.

2. Description of the Prior Art

Technical revolution has recently been advanced in the field of display panel such as liquid crystal and plasma display panels as well, and small-size lightweight computers utilizing such display panels are getting popular.

FIG. 3 shows a prior art image display system in a personal computer of the type noted above. In the FIGURE, reference numeral 1 designates an input source circuit, which consists of a microprocessor or the like and supplies pixel data to a refresh memory 8. Reference numeral 2 designates a clock source circuit including a plurality of clock sources CL1, CL2, . . ., CLN. N clock outputs from the clock source circuit 2 are supplied to a clock selection circuit 3. One of these clock outputs of the clock sources CL1 to CLN is selected by an instruction from the input source circuit 1 to be supplied to a sync signal generator 4 and a display timing signal generator 5. Reference numeral 6 designates a memory address generator, which receives signals from the sync and display timing signal generators 4 and 5 and provides an address of the refresh memory 8, in which pixel data for display is stored.

Reference numeral 7 designates an address selector, which selects an address of the input source circuit 1 when the input source circuit 1 reads or writes pixel data of the refresh memory 8 and selects an output address from the memory address generator 6 when pixel data in the refresh memory 8 is read out for display. The pixel data read out from the refresh memory 8 according to the output address from the memory address generator 6 is supplied to a display data processor 9 for conversion to a signal conforming to a form of input to a display panel (i.e., display medium) 10 in synchronism to sync signals.

Currently, there are a variety of application software including those developed in the past to be run on personal computers, while the resolution of the CRT display screen is on an increasing trend. Consequently, it has become necessary for a personal computer to be used with application software having display screens of various resolutions. For this reason, N different clock sources are provided as in the clock source circuit 2 shown in FIG. 3, and an adequate clock frequency conforming to the display screen resolution required by the application software used is selected according to an instruction provided from the input source circuit 1 to the clock selection circuit 3.

In a usual personal computer, a program, with which a microprocessor in the input source circuit 1 controls the circuit of FIG. 3, is peculier to each personal computer and conforms to the pertinent circuit construction. It is called BIOS (basic input/output system). Application software usually controls the circuit of FIG. 3 not directly but indirectly by calling an adequate program in the BIOS. In other words, the application software selects a clock source suited to its display screen resolution through a program in the BIOS. However, some application software is adapted to control the circuit of FIG. 3 directly, i.e., without agency of any BIOS.

Meanwhile, in the system of FIG. 3 using a display panel as display medium, the resolution of the display panel is fixed, for instance to 640 dots by 480 dots. This means that a clock source corresponding to the 640-dot-by-480-dot resolution should be selected at all time even if the display screen resolution of application software which is used with the system is 320 dots by 200 dots or 640 dots by 350 dots.

Therefore, if application software which directly controls the clock source switching is used with a personal computer having an image display section as shown in FIG. 3, for instance consisting of a liquid crystal display panel having a resolution of 640 dots by 480 dots, it will switch the clock source circuit 3 in accordance wiht its own 640-dot-by-350 -dot resolution display screen. In this case, normal image display on the display panel will not be obtained, or the display panel will be destroyed.

SUMMARY OF THE INVENTION

The present invention has been intended in order to solve the above problems inherent in the prior art, and its object is to provide an image display system, which can be used with application software adapted to select a clock source conforming to the display screen resolution directly, i.e., without any BIOS, as well without possibility of any clock source other than the clock source conforming to the resolution of the display panel.

According to the invention, there is provided an image display system comprising:

a clock selection circuit for receiving clock outputs of a plurality of clock sources and providing a selected clock;

a sync signal generator for receiving said selected clock from said clock selection circuit and generating sync signals conforming to a display screen;

a timing signal generator for generating various timing signals for processing display data;

a refresh memory for storing pixel data for display on said display screen;

display data processor for converting pixel data read out from said reflesh memory in correspondence to said display screen to display data conforming to said timing signals;

a display medium having a fixed display resolution for receiving the outputs of said display data processor and sync signals generator for display of data; and clock selection control means for allowing or inhibiting the clock selection by said clock selection circuit.

The above and other objects, features and advantages of the invention will become more apparent from the following description when taken in conjunction with the accompanying drawings.

DESCRIPTION OF THE PREFERRED EMBODIMENT

Figure 1:
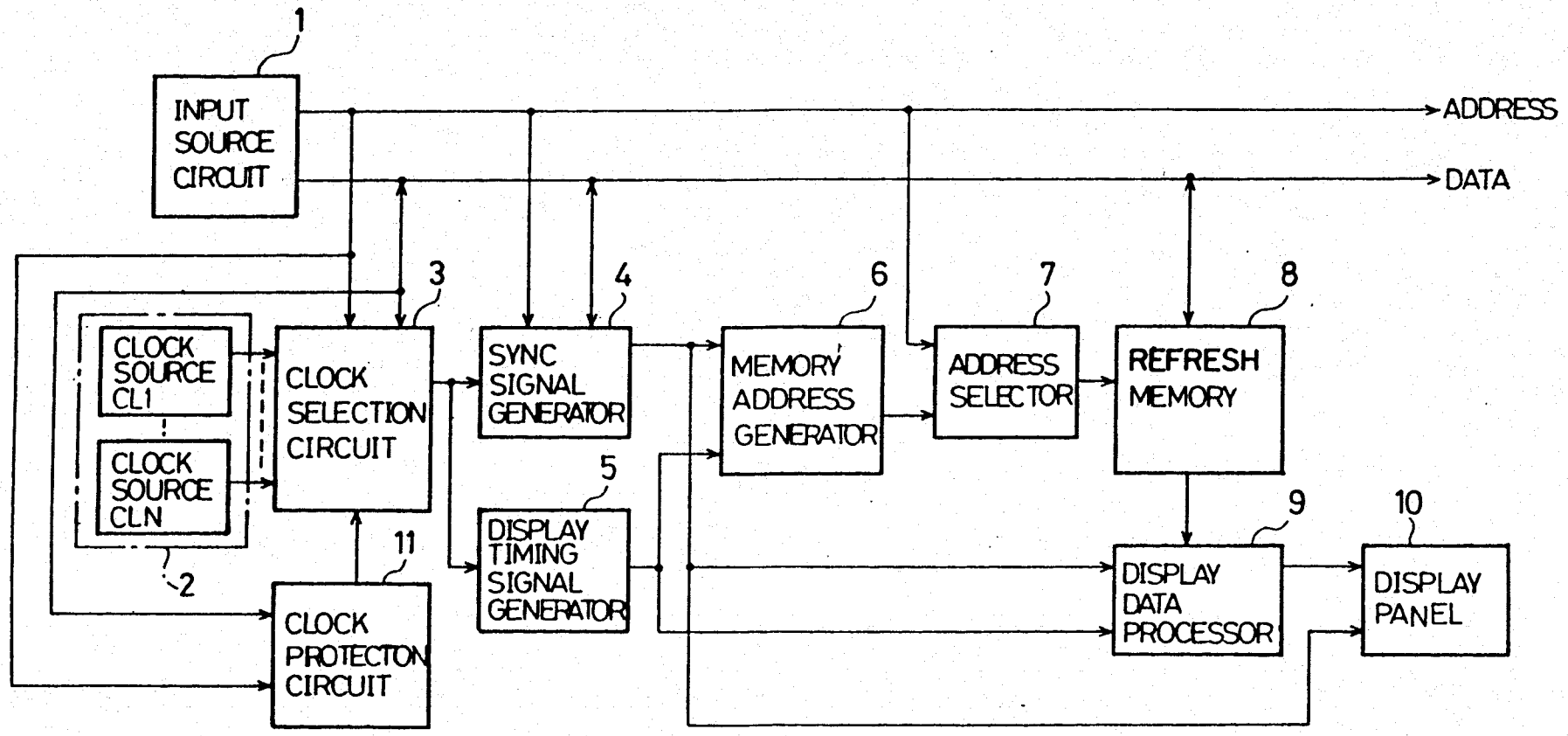
FIG. 1 is a block diagram showing an embodimnent of the image display system according to the invention.
Figure 3:
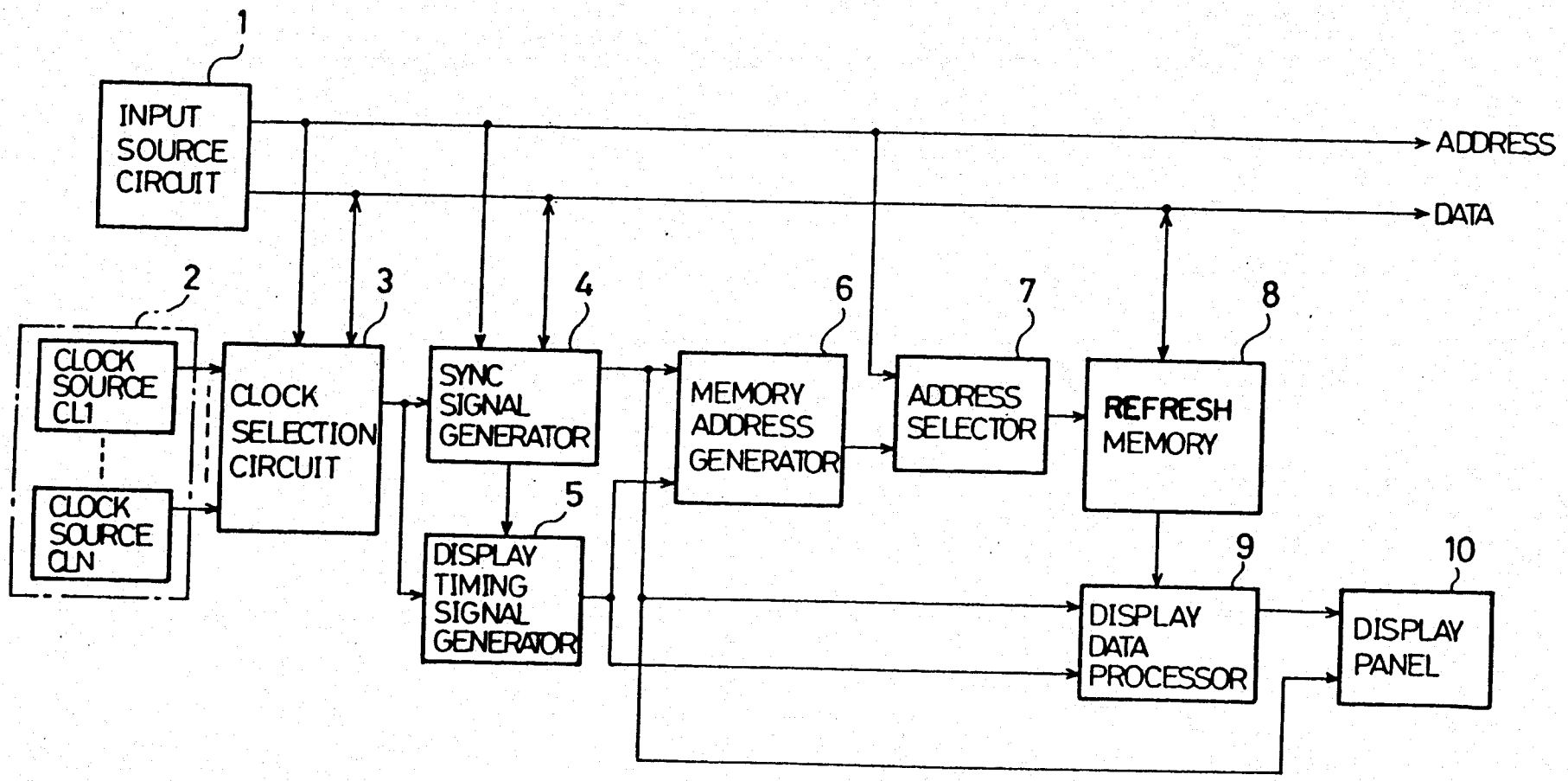
FIG. 3 is a block diagram showing a prior art image display system.

Now, an embodiment of the invention will be described with reference to the drawings. FIG. 1 is a block diagram showing an embodiment of the image display system according to the invention. In FIG. 1, parts like those in FIG. 3 are designated by like reference numerals. Reference numeral 11 designates a clock protection circuit (or clock selection controller) for allowing or inhibiting the control of the clock selection circuit 3 by the input source circuit 1.

Figure 2:
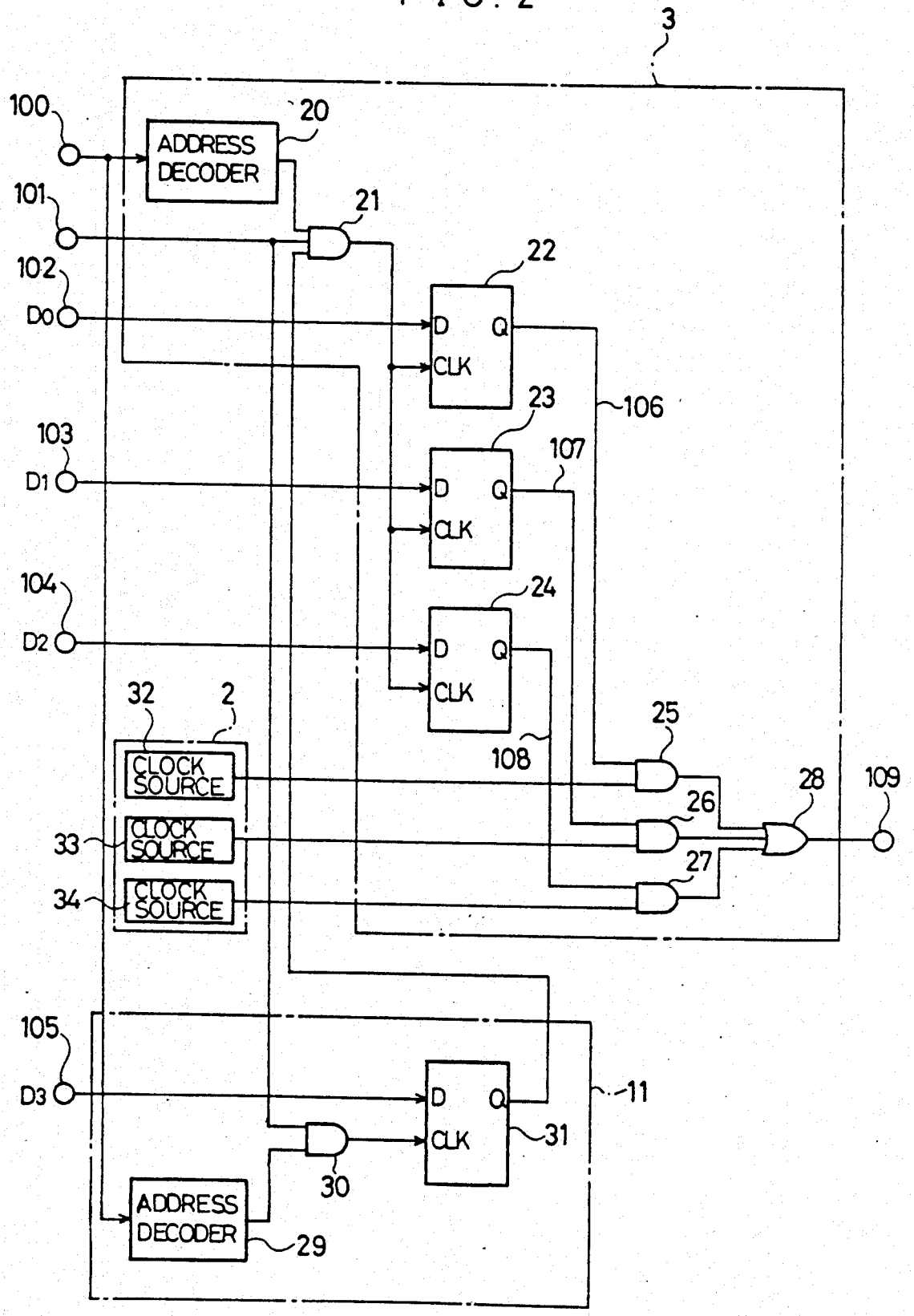
FIG. 2 is a circuit diagram showing an example of a clock source circuit, a clock selection circuit and a clock selection controller according to the invention.

A specific example of the clock source circuit 2, clock selection circuit 3 and clock selection controller 11 in the system of FIG. 1 is shown in FIG.2 for describing the operation of the clock selection controller 11. Referring to FIG. 2, there are shown three clock sources. That is, the clock source circuit 2 consists of three clock sources 32 to 34. The clock selection circuit 3 includes an address decoder 20, D latches 22 to 24, a 3-input AND gate 21, 2-input AND gates 25 to 27 and a 3-input OR gate 28. The clock selection controller 11 includes an address decoder 29, a D latch 31 and a 2-input AND gate 30.

In the clock selection circuit 11 having the above construction, an address 100 is supplied from the input source circuit 1 to the address decoder 29. The address decoder 29 provides an output at "H" level when and only when the input address 100 coincides with an address value assigned to it, and otherwise it provides an output at "L" level. One input to the AND gate 30 is constituted by the output of the address decorder 29, while the other input is constituted by a write signal 101 provided from the input source circuit 1. Thus, the write signal 101 is effective only while the address assigned to the clock selection circuit 11 is provided, and the D latch 31 latches its D input from the input source circuit 1, i.e., data D3 105.

In the clock selection circuit 3, the output of the decorder 20 is similarly supplied to the AND gate 21, to which are also supplied the write signal 101 and output of the D latch 31. Thus, when the input source circuit 1 writes data in the clock selection circuit 3 with the output of the D latch 31 at the "H" level, the write signal 101 is passed through the AND gate 21 and supplied to a clock input terminal of each of the D latches 22 to 24, and data inputs Do to D2 102 to 104 are written in the D latches 22 to 24.

If DO =0, D1 =1 and D2 =0, the outputs 106 to 108 of the D latches 22 to 24 are at the "L", "H" and "L" levels, respectively. The output 106 of the D latch 22 and clock of the clock source 32 are supplied to the AND gate 25. Since the output 106 is at the "L" level, the AND gate 25 provides an output at "L" level. The output 107 of the D latch 23 and clock of the clock source 33 are supplied to the AND gate 26. Since the output 107 is at the "H" level, the AND gates 26 passes the clock of the clock source 33. The output 108 of the D latch 24 and clock of the clock source 34 are supplied to the AND gate 27. Since the output 108 is at the "L" level, the AND GATE gate 27 provides an output at "L" level. The clock of the clock source 33 is provided as the output 109 of the OR gate 28.

Since the output of the D latch 31 in the clock selection controller 11 is provided to the AND gate 21, the writing of data in the clock selection circuit 3 is allowed when the output of the D latch 31 is at the "H" level. When the output of the D latch 31 is at the "L" level, the writing of data in the clock selection circuit 3 is inhibited, that is, no data written in the circuit 3 is effective.

Thus, when initializing the image display system according to the invention at the time of the start of operation, the clock source conforming to the resolution of the display panel is selected using a BIOS program. That is, data is written in the clock selection circuit 11, and then data "0" is written in the clock selection controller 11 to render the output of the D latch 31 to be at the "L" level. When the application software is run in this state, even if seeks to write data in the clock selection circuit 3 directly, i.e., without agency of any BIOS, the clock source that has been selected is not changed, and normal display can be obtained.

As has been described in the foregoing, with the image display system according to the invention a circuit for controlling the allowing/inhibition of data in the clock selection circuit form the input source circuit is provided to inhibit writing of data in the clock selection circuit directly by application software. It is thus possible to permit an image display system using a display panel having a fixed resolution to provide normal display when the system is used with any application software.

What is claimed is:

1. An image display system for displaying data at one of a plurality of display resolutions, a corresponding clock signal being selected to display the data at the one resolution, comprising:

a clock selection circuit receiving clock signals from a plurality of clock sources for selecting a clock signal in response to an active allow-inhibit signal;

a sync signal generator receiving said selected clock signal from said clock selection circuit for generating sync signals in response to said selected clock signal;

a timing signal generator receiving said selected clock signal for generating various timing signals for processing the display data;

refresh memory for storing pixel data;

display data processor for converting said pixel data read out from said refresh memory to said display data in response to said timing signals;

a display medium having a fixed display resolution and receiving said display data and sync signals for forming a display pattern; and clock selection control means for generating said allow/inhibit signal in response to an address signal, a write-enable signal and a control signal.

2. The image display system according to claim 1, wherein said clock selection control means comprises:

an address decoder receiving an address signal for determining whether said received address signal corresponds to a prescribed address, said decoder generating an output which is active when said prescribed address is detected;

an AND gate receiving the output of said address decoder and said write-enable signal, the AND gate generating an output which is active when said address decoder output is active and said write-enable signal is active; and a latch receiving the output of said AND gate and said control signal for latching the control signal logic state when the AND gate output is active, said latched control signal state defining the allow-/inhibit signal;

wherein the allow/inhibit signal is active to allow clock signal selected when said latched control signal defines an active state and wherein the allow/inhibit signal is inactive to inhibit a change of the clock signal selection when said latched control signal defines an inactive state.

3. The image display system according to claim 1, wherein said clock selection circuit comprises:

an address decoder receiving said address signal for determining whether said received address signal corresponds to said prescribed address, said decoder generating an output which is active when said prescribed address is detected;

an AND gate for receiving said allow/inhibit signal, said decoder output, and said write-enable signal, the AND gate generating an output which is active when said decoder output is active, said write-enable is active and said allow/inhibit signal is active, wherein said clock selection circuit selects a clock signal while said second AND gate output is active.

4. The image display system according to claim 2, wherein said AND gate and said decoder of said clock selection control means are a first AND gate and a first decoder, means, and wherein said clock selection circuit comprises:

a second address decoder receiving said address signal for determining whether said received address signal corresponds to said prescribed address, said second decoder generating an output which is active when said prescribed address is detected;

a second AND gate for receiving said allow/inhibit signal, said second decoder output, and said write-enable signal, the second AND gate generating an output which is active when said second decoder output is active, said write-enable signal is active and said allow/inhibit signal is active, wherein said clock selection circuit selects a clock signal while said second AND gate output is active.

* * * * *